US005803349A

United States Patent [19]

Ljungstrom

[11] Patent Number: 5,803,349

[45] Date of Patent: Sep. 8, 1998

[54] INCREASED SPOUT ANGLE TO ASSIST WITH OPENING

[76] Inventor: Tommy Bo Goran Ljungstrom, Ribbgrand 1, S 243 33 Hoor, Sweden

[21] Appl. No.: 918,494

[22] Filed: Aug. 22, 1997

[51] Int. Cl.[6] ..... B65D 5/08

[52] U.S. Cl. ..... 229/137; 229/930; 229/125.42; 229/213; 229/214

[58] Field of Search ..... 229/137, 138, 229/125.42, 213, 214, 184, 930

[56] References Cited

U.S. PATENT DOCUMENTS

| | | | |
|---|---|---|---|
| 2,097,647 | 11/1937 | Scott . | |
| 3,125,274 | 3/1964 | Zinn | 229/214 X |
| 3,185,375 | 5/1965 | Thomas . | |
| 3,232,516 | 2/1966 | Arslanian | 229/125.42 |
| 3,272,425 | 9/1966 | Bendersky et al. . | |
| 3,348,755 | 10/1967 | MacEwen . | |
| 4,327,861 | 5/1982 | Thompson . | |
| 4,450,581 | 5/1984 | Hirata . | |
| 4,846,396 | 7/1989 | Palazzolo . | |
| 5,118,036 | 6/1992 | Mandersson | 229/241 |
| 5,474,232 | 12/1995 | Ljungstrom et al. | 229/137 |
| 5,725,147 | 3/1998 | Ljungstrom et al. | 229/137 |

*Primary Examiner*—Allan N. Shoap
*Assistant Examiner*—Tri M. Mai

[57] ABSTRACT

A gable top carton and its corresponding carton blank are disclosed. The carton includes two indent surfaces near the gable top that are defined by a score line configuration that facilitates controlled deformation of the gabled top to increase the roof angle of the top so as to limit the risk of rolling.

32 Claims, 16 Drawing Sheets

INCREASED SPOUT ANGLE TO ASSIST WITH OPENING

BACKGROUND OF THE INVENTION

1. Field of the Invention

The present invention is directed to a packaging container and its corresponding blank configuration. More particularly, the present invention is directed to a gable top carton including a score line configuration that defines indent surfaces to which pressure may be applied to facilitate proper opening of the carton.

2. Description of the Related Art

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

When fully folded, filled, and sealed, most gable top cartons include a gabled top structure that engages a plurality of side panels. These side panels form a hollow rectangular body. At the end of this hollow rectangular body opposite the gabled top structure, there is a bottom structure.

The bottom structures of the prior art may be formed in accordance with several different constructions. A first construction is shown in U.S. Pat. No. 3,164,315, issued on Jan. 5, 1965 to N. A. Kelly. As illustrated in that patent, the bottom is formed primarily by four bottom panels that engage the side panels at respective straight score lines that each define a straight crease. Two bottom panels each include two converging score lines. The other two bottom panels do not include further score lines. One of the two non-scored bottom panels is longer than the other. When folded, a portion of the longer, non-scored bottom panel overlaps a portion of the opposite non-scored bottom panel to assist in sealing the bottom structure.

Although the bottom structure of the carton disclosed in the '315 patent provides generally adequate sealing, there is room for improvement. For example, the portion of the longer, non-scored bottom panel that overlaps the opposite non-scored bottom panel forms a ridge which does not allow the container to sit flat on a surface. Instead, the ridge tends to form a fulcrum that renders the carton unstable. Such bottom structures are also subject to bulging which renders them relatively unstable when seated. The bottom seal of such a carton is also subject to wear since it is in direct contact with the surface on which the carton is seated. Additionally, depending on the container contents, the bottom structure may require mechanical sealing strength characteristics beyond those offered by the standard four panel structure.

Another bottom construction is shown in U.S. Pat. No. 5,152,736, issued Oct. 6, 1992, to Owen et al. In that construction, the fin flaps of the bottom structure are cut diagonally and engage bottom flaps at diagonal score lines. During the filling and sealing process, the resulting fin is gripped by specialized sealing jaws and forced upward so that the fin does not interfere with seating of the carton. The side panels engage the bottom structure at straight score lines that define straight creases. The fin is then sealed, in a separate sealing step, by folding the fin flat and heat sealing it to one of the bottom flaps of the container.

The '736 construction has several disadvantages. For example, all four side panels engage the bottom flaps at straight score lines that define straight creases. A downward force is thus exerted on the bottom structure by all four panels, as well as the container contents, to urge the bottom flaps and bottom fin flaps from their non-interfering position when the carton is seated upright. As a result, the bottom seal may become unduly stressed and/or move toward an interfering position. Compensation for this added stress may be achieved, for example, by increasing the thickness of the heat sealing layers of the container to increase the strength of the bottom heat seal. However, this results in added production costs, particularly when large production volumes are contemplated.

The gabled tops of standard gable top cartons are typically formed primarily from four top flaps that engage respective side panels of the carton at respective straight score lines that each define a straight crease. Two of the top flaps each include two converging diagonal score lines. The top flaps each engage a respective top fin flap that is divided from the top flap by a respective score line. These structures are folded to form the familiar gable structure that includes an upright fin. One end of the gabled structure constitutes an opening end that has its fin flaps sealed, for example, with an adhesive resin. The user inserts his/her thumbs into an open space beneath the fin flaps to pry them apart and access the container contents. The other end of the gabled structure is typically designated as the closed end and is not designed to be opened by the user.

The conventional gabled top structure suffers from disadvantages in certain situations. In particular, miniature gable top cartons may be difficult to open since the open region beneath the fin flaps at the opening end may not be large enough to accommodate the user's thumbs. The requirement that the open region accommodate the user's thumbs also places a constraint on the height of the gabled structure, even where the carton itself is of a conventional size (i.e., I liter).

Another disadvantage of the conventional gabled top structure is that the gable does not allow the user to bend back the at the opening end more than the angle of the gabled roof. As a result, "rolling" often occurs. That is the spout does not bend at the performed diagonal crease on each of the top side flaps that form the oppositely angled roof portions of the gable structure. When the spout does not bend at the performed diagonal creases, the carton often will not open properly.

This problem becomes particularly apparent when so-called "low profile gable-tops" are used. Such low profile gable-top containers lower container material costs since the surface area for a given container volume is reduced and, further, are more space efficient due to the reduced height of the gabled top portion of the container. These containers, however, are sometimes particularly susceptible to the foregoing "rolling" problem since the angle of the low profile gabled top is substantially reduced over the angle of the more conventional tops.

BRIEF SUMMARY OF THE INVENTION

A gable top carton and its corresponding carton blank are disclosed. In accordance with one embodiment of the gable top-carton, the carton has a gabled structure having an opening end, a fin, and first and second oppositely angled roof portions extending from and engaging the fin. The first and second oppositely angled roof portions form spout flaps at the opening end that are adapted for folding back along a predefined score line configuration during opening of the carton. A plurality of side panels engage the gabled structure, including first and second opposite side panels respectively engaging the first and second oppositely angled roof portions. A first score line defines a crease loaned at the engagement between the first side panel and the first angled roof portion while a second score line defines a crease formed at the engagement between the second side panel and the second angled roof portion. A first complementary score line on the first side panel is disposed adjacent said first score line and defines a first indent surface there between while a second complementary score line on the second side panel is disposed adjacent the second score line and defines a second indent surface therebetween. Preferably, the complementary score lines are curved and extend along the entire length of the respective side panel. Optionally, a further set of complementary score lines may be provided respectively on the first and second angled roof portions.

In opening the foregoing cartons, the user may apply a pressure to the first and second indent surfaces to deform the surface and thereby increase the roof angle. By increasing the roof angle, the user can more easily push the spout flaps further back, which reduces the risk of rolling, and makes it easier to push the spout forward to open the carton. Moreover, increasing the roof angle provides more room for acceptance of a users thumbs, or the like, to pry open the top fin and allow user access to the contents of the carton.

A blank for forming the foregoing carton is also contemplated herein, as is a method of opening the carton.

DETAILED DESCRIPTION OF THE INVENTION

Figure 1:
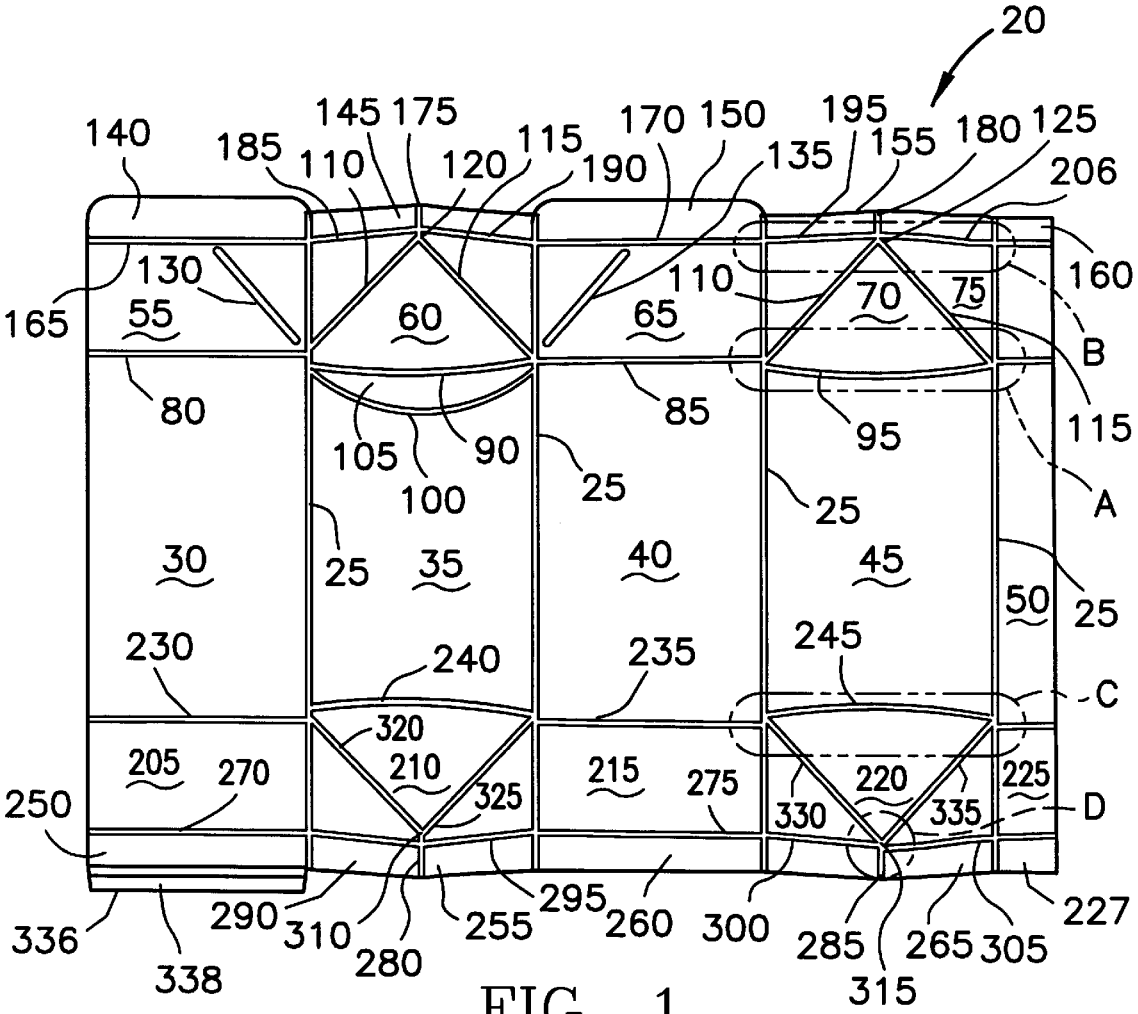
FIG. 1 is a plan view of one embodiment of a carton blank constructed in accordance with the teachings of the present invention.

FIG. 1 illustrates one embodiment of a blank that may be used to form a carton in accordance with the teachings of the present invention. Such a blank is described in U.S. Pat. No. 5,474,232 which is hereby incorporated by reference. The carton blank 20 has a plurality of panels that are effectively separated from one another by a plurality of score lines. The carton blank 20 is divided by four vertical score lines 25 into first, second, third, fourth and fifth side panels respectively noted as 30, 35, 40, 45, and 50. The fifth side panel 50 has a smaller width than the other side panels and, as will be shown in further detail below, is used to side seal the carton. At the top of the carton blank 20, the side panels 30, 35, 40, 45, and 50 engage respective first, second, third, fourth, and fifth top flaps 55, 60, 65, 70, and 75. The first side panel 30 and the adjacent first top flap 55 are divided from one another by a straight score line 80. Likewise, the third side panel 40 and the adjacent third top flap 65 are divided from one another by a straight score line 85. The second side panel 35 and the adjacent second top flap 60 are divided from one another by a curved score line 90. Likewise, the fourth side panel 45 and the adjacent fourth top flap 70 are divided from one another by a curved score line 95. The second side panel 35 includes a further curved score line 100 adjacent the curved score line 90. As will be explained in further detail below, the curved score lines 90 and 100 of the second side panel 35 define an indent surface 105 therebetween.

Further score lines are provided in the top flaps to assist in defining the creases that will ultimately be made when the blank 20 is folded into a gable top carton. The second and fourth top flaps 60 and 70 each include a pair of diagonal lines 110 and 115 that converge at respective apices 120 and 125. The first and third top flaps 55 and 65 each include a respective diagonal score line 130 and 135 that, as will be apparent from the following discussion, assists in defining the opening end of the carton.

Immediately adjacent the first, second, third, fourth, and fifth top flaps are respective first, second, third, fourth, and fifth top fin flaps 140, 145, 150, 155, and 160. The first and third fin flaps 140 and 150 are generally rectangular with curved corners. The first top panel 55 and the third top panel 65 are divided from their respective top fin flaps 140 and 150 by respective straight score lines 165 and 170. The second and fourth fin flaps 145 and 155 include respective angled top edges. The second and fourth top fin flaps 60 and 70 each include a respective vertical score line 175 and 180. Angled score lines 185, 190, 195, and 200 proceed from the apices 120 and 125 of the second and fourth top flaps and divide the second and fourth top flaps 60 and 70 from the respective second and fourth top fin flaps 145 and 155. The angled score lines 185, 190, 195, and is 200 are generally parallel to the angled top edges of the second and fourth top fin flaps 145 and 155.

At the end of the blank 20 opposite the top panel structures, the first, second, third, fourth, and fifth side panels engage respective first, second, third, fourth, and fifth bottom flaps 205, 210, 215, 220 and 225. The first side panel 30 and the adjacent first bottom 0 flap 205 are divided from one another by a straight score line 230. Likewise, the third side panel 40 and the adjacent third bottom flap 215 are divided from one another by a straight score line 235. The second side panel 35 and the adjacent second bottom flap 210 are divided from one another by a curved score line 240. Likewise, the fourth side panel 45 and the adjacent fourth bottom flap 220 are divided from one another by a curved score line 245.

Immediately adjacent the first, second, third, fourth, and fifth bottom flaps are respective first, second, third, fourth, and fifth bottom fin flaps 250, 255, 260 265, and 227. The first and third bottom fin flaps 250 and 260 are generally rectangular and, in the illustrated embodiment, are not as wide as the corresponding first and third top fin flaps 140 and 150. The first bottom flap 205 and the third bottom flap 215 are divided from their respective bottom fin flaps 250 and 260 by respective straight score lines 270 and 275. The second and fourth bottom fin flaps 255 and 265 include respective angled bottom portions. The second and fourth bottom fin flaps 255 and 265 each include a respective vertical score line 280 and 285. Angled score lines 290, 295, 300, and 305 proceed from the apices 310 and 315 of the converging score lines 320, 325, 330, and 335 of the second and fourth bottom flaps 210 and 220. The angled score lines divide the second and fourth bottom flaps 210 and 220 from the respective second and fourth bottom fin flaps 255 and 265. The angled score lines 290, 295, 300, and 305 are generally parallel to the corresponding angled bottom edges of the first and second bottom fin flaps 255 and 265. Score lines 295, 275, and 300 extend between the apices 310 and 315 and are of a greater width than the score lines 270, 290, and 305. For example, the score lines 275, 295, and 300 may be approximately twice as wide as score lines 270, 290 and 305.

A fin extension tab panel 336 extends from the first bottom fin flap 250. The extension tab panel 336 is divided from the first bottom fin flap 250 by a wide score line 338. For example, the wide score line 338 may have a width that is approximately twice as wide as the width of score line 270.

The top and bottom curved creases 90, 95, 240, and 245 may have different radii depending on the size of the carton. For example, a 47 mm×47 mm cross section carton may have top curved creases with radii of 200 mm and bottom curved creases with radii of 200 mm. A 70 mm×70 mm carton may have top curved creases with radii of 350 mm and bottom curved creases with radii of 700 mm. A 95 mm×95 mm carton may have top curved creases with radii of 600 mm and bottom curved creases with radii of 1200 mm. The curved crease 100 may, for example, have a radius of 75 mm for a 70 mm×70 mm carton.

Figure 1A:
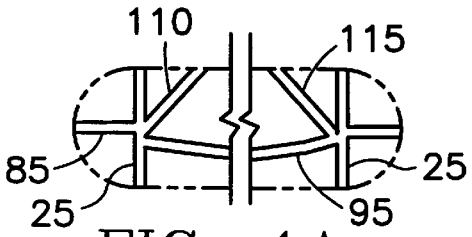
FIGS. 1A–1D are exploded views of various score lines of the carton blank shown in FIG. 1.
Figure 1B:
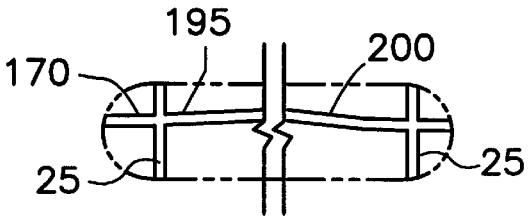
Figure 1C:
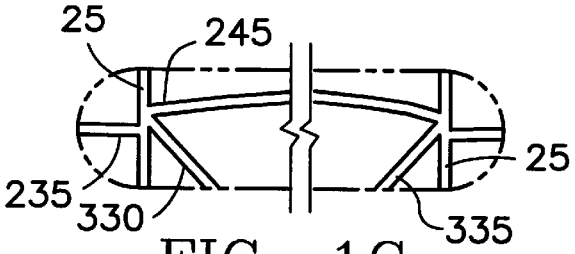
Figure 1D:
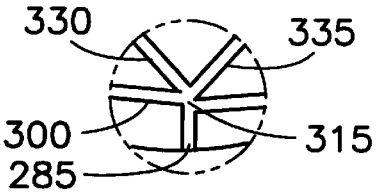

FIGS. 1A, 1B, 1C, and 1D are exploded sectional views respectively of sections A,B, C, and D of FIG. 1. The exploded figures illustrate the relative orientation and position of the score lines of each of the respective labeled sections. As illustrated in FIG. 1A, the top curved score lines 90 and 95 are offset below the score line 85. Similarly, as illustrated in FIG. 1C, the bottom curved score lines 240 and 245 are offset above the score line 235.

Figure 2:
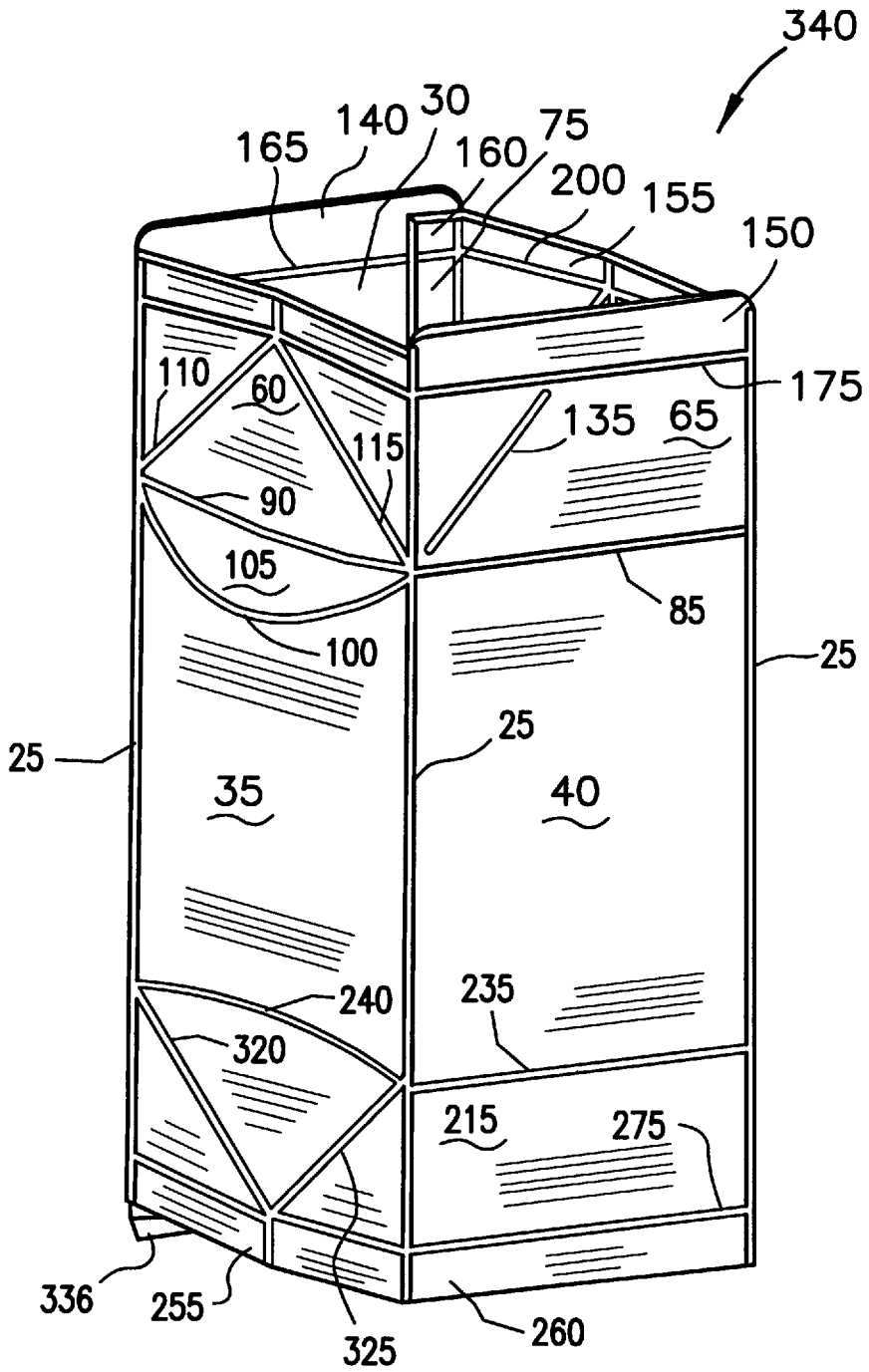
FIG. 2 is a perspective view of the carton blank formed into a hollow rectangular body after sealing the first and fifth side panels to one another.

FIG. 2 illustrates the blank 20 of FIG. 1 at an intermediate folded stage. At this stage, a hollow rectangular structure 340 is formed by folding the carton blank 20 of FIG. 1 along the vertical score lines 25 to form vertical creases. The exterior surfaces of the fifth top fin flap 160, the fifth top flap 75, the fifth side panel 50, the fifth bottom flap 225, and the fifth bottom fin flap 227 are joined to the interior surfaces of the edge of the corresponding first top fin flap 140, the first top flap 65, the first side panel 30, the first bottom flap 205, and the first bottom fin flap 250. This joining may occur, for example, by heat sealing the panels together. Other adhesion methods are also contemplated.

The intermediately folded structure illustrated in FIG. 2 is further foldable to form top and bottom gabled structures. The top fin flaps and top flaps of the structure shown in FIG. 2 are foldable along the illustrated score lines to form a top gabled structure. Similarly, the bottom fin flaps and the bottom flaps of the structure shown in FIG. 2 are foldable along the illustrated score lines to form a bottom gabled structure.

Figure 3:
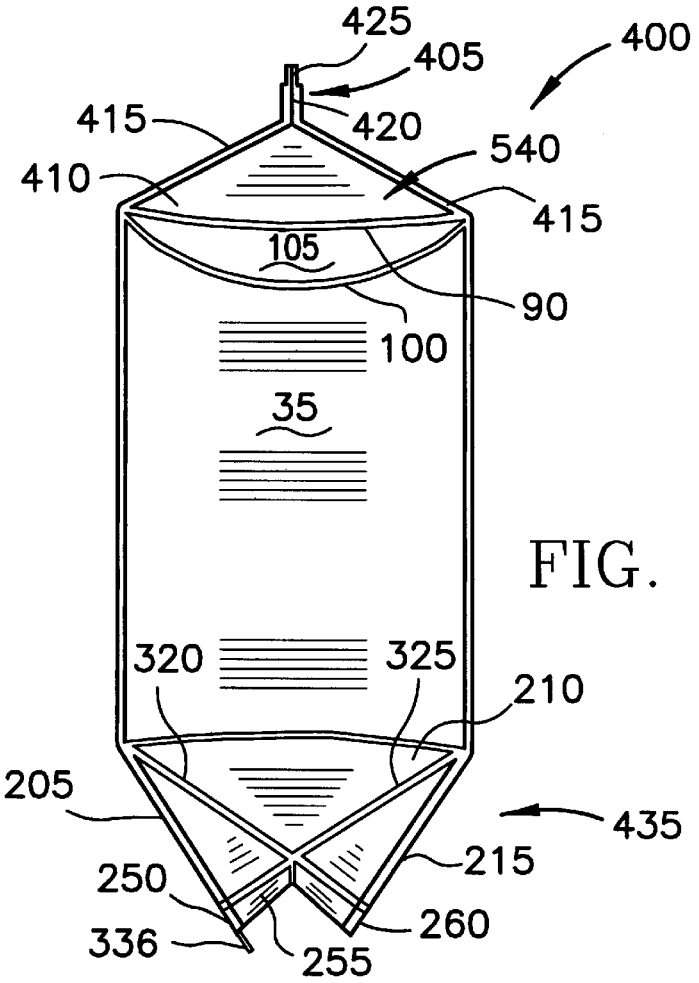
FIG. 3 is a side elevational view of the carton at an intermediate folded stage in which the top gabled section has been sealed.

FIG. 3 illustrates the blank 20 of FIG. 1 at a further intermediate folded stage. In this stage, the top gabled structure 400 has been fully formed. The top gabled structure 400 includes an upstanding fin 405 and underlying and overlying gabled walls 410 and 415. The upstanding fin 405 includes a four layered portion 420 and a two layered portion 425. The four layered portion 420 is comprised of the overlapping sections of all of the top fin flaps while the two layered portion 425 is comprised of the upper portions of the first and third top fin flaps. The fin flaps are joined together, for example, by heat sealing. The underlying gabled wall 410 of the top gabled structure 400 engages side panel 35 at the curved score line 90 (see also FIG. 1) which, in this folded condition, defines a curved crease. The score line 100 extends across the width of the side panel 35 adjacent the curved crease formed at score line 90'. The area between the score line 100 and the curved crease constitutes an indent surface 105.

FIG. 3 also illustrates the bottom gabled section 435 in a partially folded state. In this state, the first and third bottom flaps 205 and 215 and bottom fin flaps 250 and 260 are urged toward one another while the second and fourth bottom flaps 210 and 220 and bottom fin flaps 255 and 265 are likewise urged toward one another. In this process, the first and third bottom flaps are broken along the converging diagonal score lines 320, 325, 330, and 335 (see also FIG. 1) to allow the bottom flaps 210 and 220 to fold toward one another.

Figure 4:
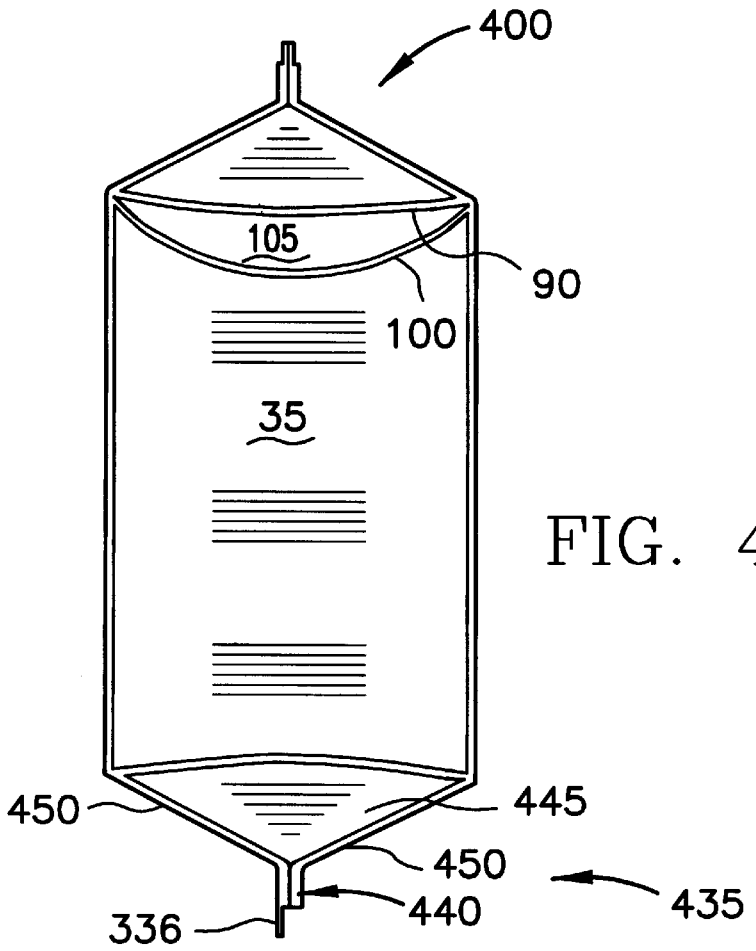
FIGS. 4 and 5 are side elevational views of the carton at a further intermediate folded stage illustrating folded top and bottom gabled structures.
Figure 5:
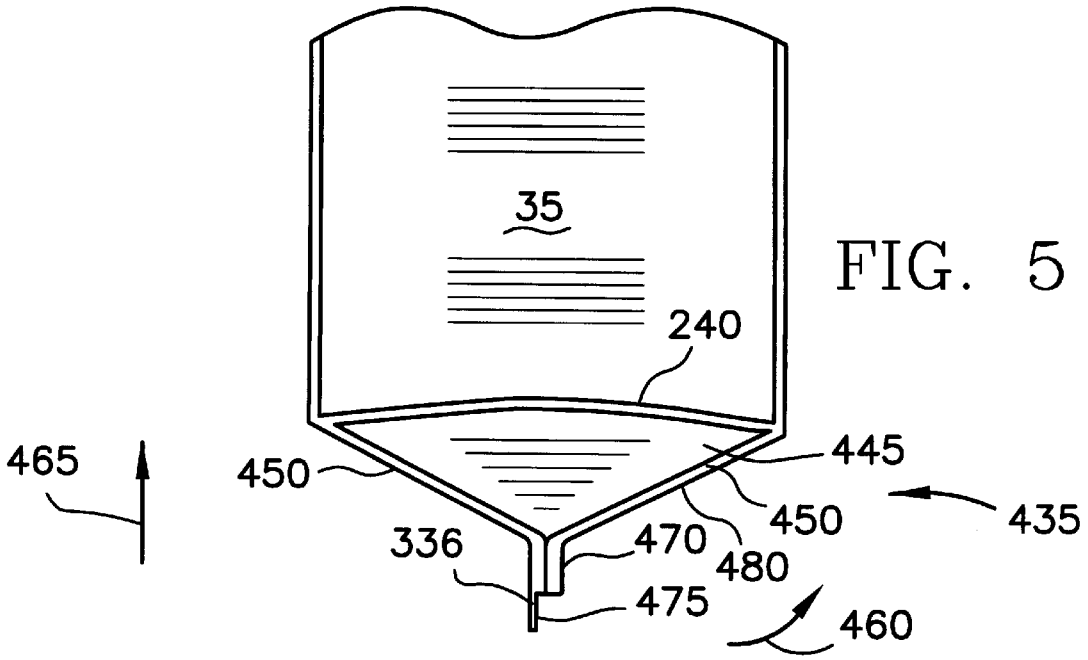
Figure 6:
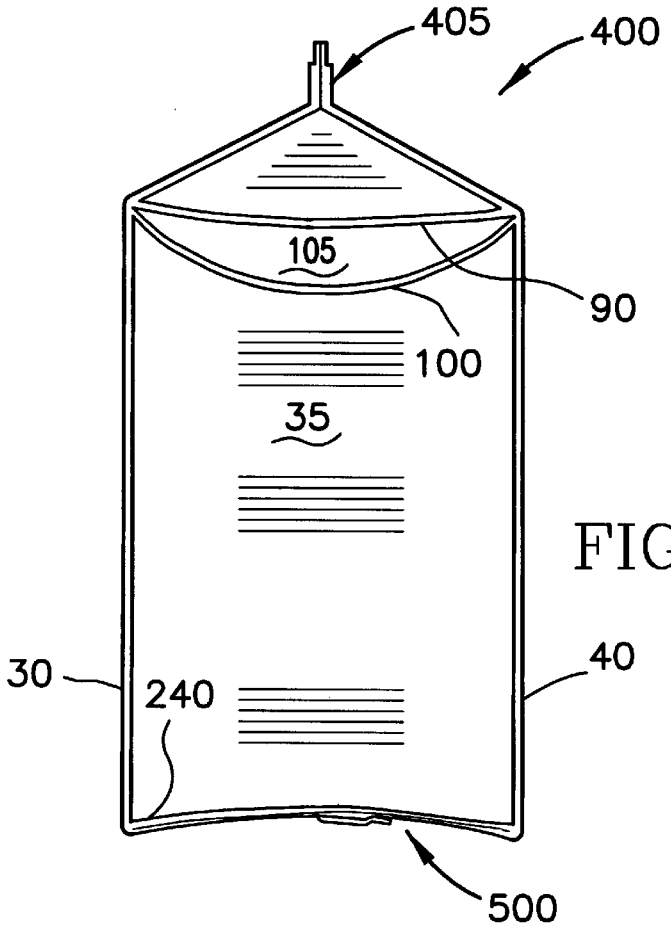
FIGS. 6 and 7 are side elevational views of the fully folded carton.
Figure 7:
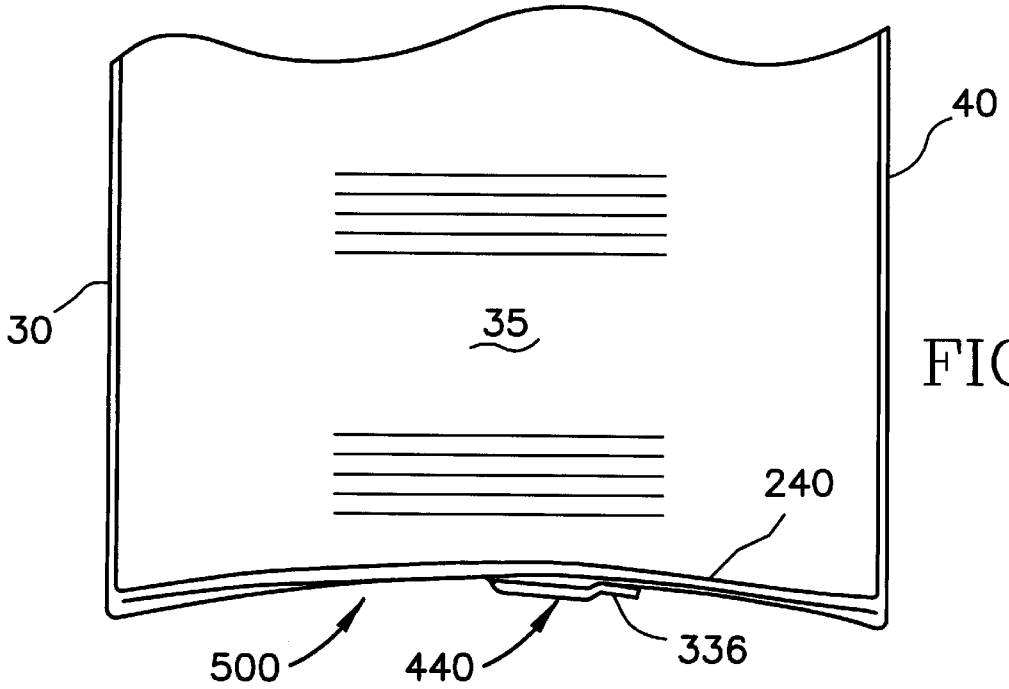

FIGS. 4 and 5 illustrate the blank 20 of FIG. 1 in a still progressively further folded stage. In this stage, the bottom gabled structure 435 is fully formed and includes a bottom fin 440, underlying and overlying gabled walls 445 and 450 (only one underlying wall illustrated), and the fin extension tab 336. The underlying walls 445 of the bottom gabled structure 435 engage the second and fourth side panels 35 and 45 at the curved score lines 240 and 245 and define respective curved creases, The bottom fin 440, unlike the top fin of the present embodiment, includes only a four layered portion that is defined by overlapping sections of all of the bottom fin flaps.

The bottom gabled structure 435 interferes with seating of the formed carton while in the position illustrated in FIGS. 4 and 5. Accordingly, the fin 440 and fin extension tab 336 of the bottom gabled structure 435 are folded over the overlying gabled wall 450 in the direction shown by arrow 460 of FIG. 5. Once the fin 440 and fin extension tab 336 are folded over the overlying gabled wall 450, the bottom gabled structure 435 is urged upward in the direction indicated by arrow 465 of FIG. 5. The surface 470 of the fin 440 and the surface 475 of the fin extension tab 336 are then joined to the exterior surface 480 of the overlying gabled wall 450. Wide score line 338 (FIG. 1) allows the fin extension tab 336 to extend over the edges of the fin 440 and seal to the surface 480 without the creation of an undue amount of space between the fin 440 and fin extension tab 336 that might otherwise compromise the integrity of the bottom seal.

Figure 8:
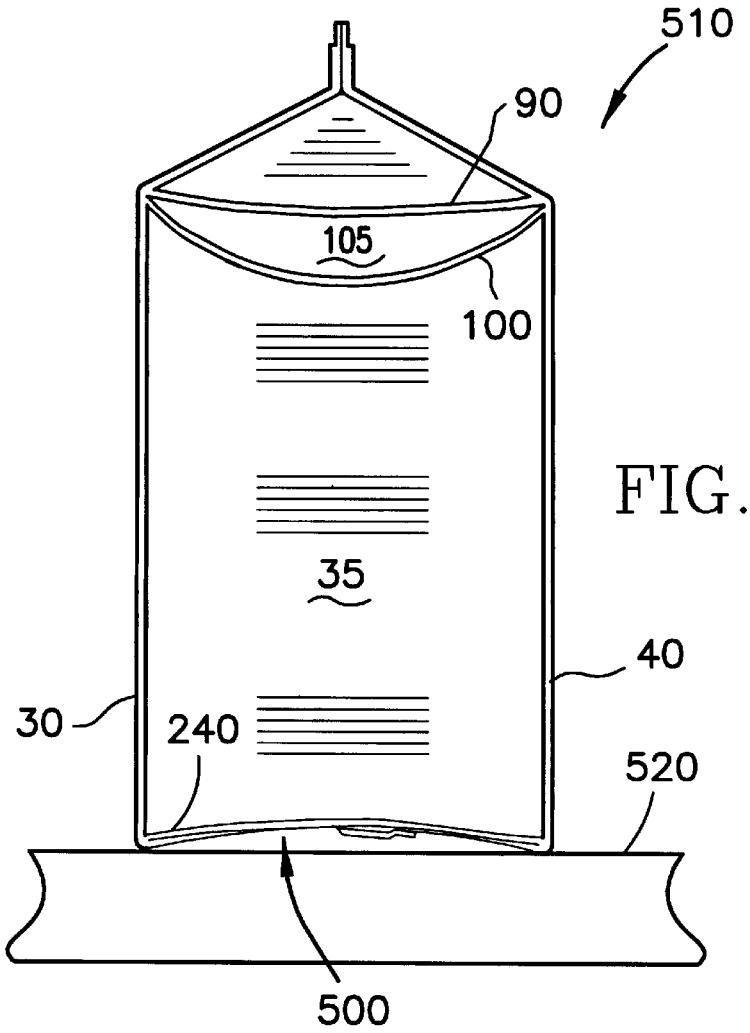
FIG. 8 is a side elevational view of the fully folded carton seated on a flat surface.
Figure 9:
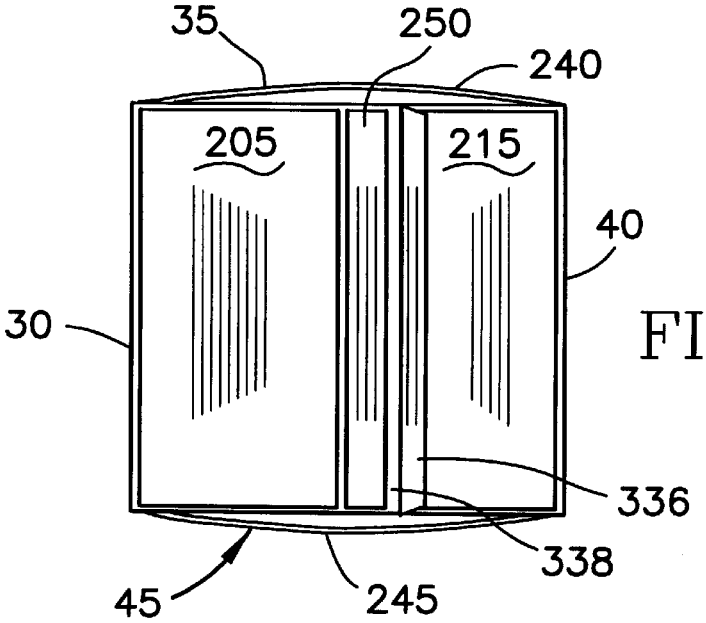
FIG. 9 is a bottom view of the carton showing the gable bottom and extension tab after both have been folded and sealed.

The resulting folded gabled structure is shown in FIGS. 6, 7, 8, and 9. As illustrated, the folded gabled structure 500 is disposed in a concave recess that is defined by the curved score lines 240 and 245 (FIG. 1) along which the curved creases are formed. In this position, as shown in FIG. 8, the folded gabled structure 500 does not interfere with the seating of the formed carton 510 on a flat surface 520. Instead of resting on the bottom gabled structure, the bottom edges of the first and third side panels 30 and 40 support the carton 510. This configuration allows the integrity of the bottom seal of the carton to be maintained since the folded gabled structure is not subject to wear from frictional contact with the flat surface 520 on which the carton 510 is seated. Additionally, the magnitude of the natural downward force on the folded gabled structure is not as great as would be exerted in the absence of the curved creases. The construction of the bottom structure illustrating the wide score line 338 is shown in detail in FIG. 9 which is a bottom view of the carton 510.

Figure 10:
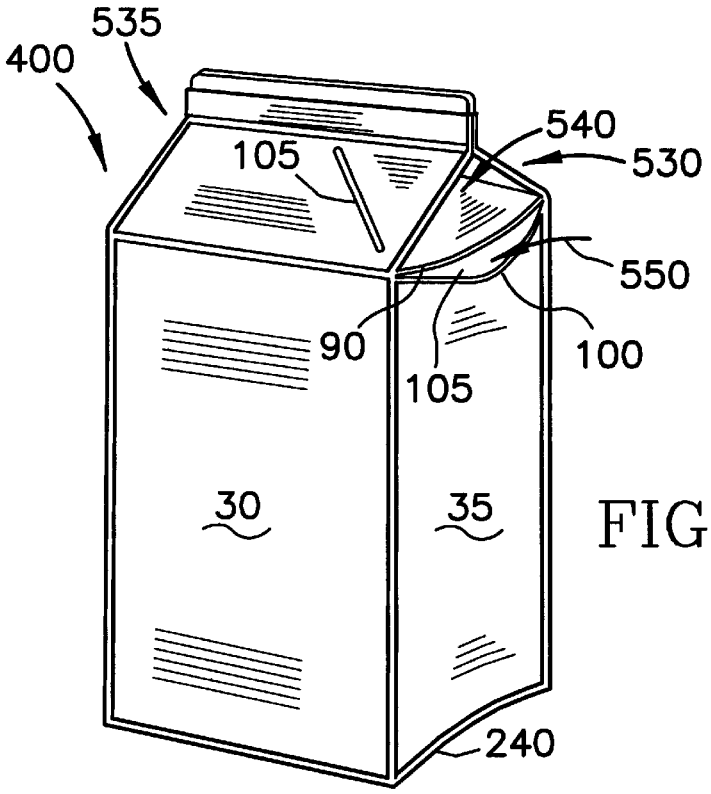
FIG. 10 is a perspective view of the folded and sealed carton.

Referring to FIG. 10, the top gabled structure 400 includes an opening end 530 and a closed end 535. The opening end 530 of the top gabled structure 400 engages the second side panel 35 at the curved score line 90 (FIGS. 1 and 3) that defines a curved crease. An open area 540 is provided to accept, for example, the thumbs of the user to allow the user to pry the layers of the fin 405 apart in the region of the opening end 530. In many instances, the open area 540 alone may be insufficient to allow the user to pry the carton open. For example, where the top gabled structure has a low profile, the open area 540 may not be large enough to accommodate the thumbs of the user. Similarly, the open area 540 may not be large enough where the carton 340 is relatively small in size.

To overcome many of the problems associated with small opening areas, the carton 340 includes the further curved score line 100 that extends across the width of the second side panel 35. Between the curved score line 90 and curved score line 100 there is the indent surface 105. The indent surface 105 may be urged in the direction shown by arrow 550 to flatten the indent surface area 105 and provide a larger effective opening area 540. With the effective opening area increased, it becomes easier for the user to obtain a position from which the top fin 405 adjacent the opening end 530 may be opened.

Figure 11:
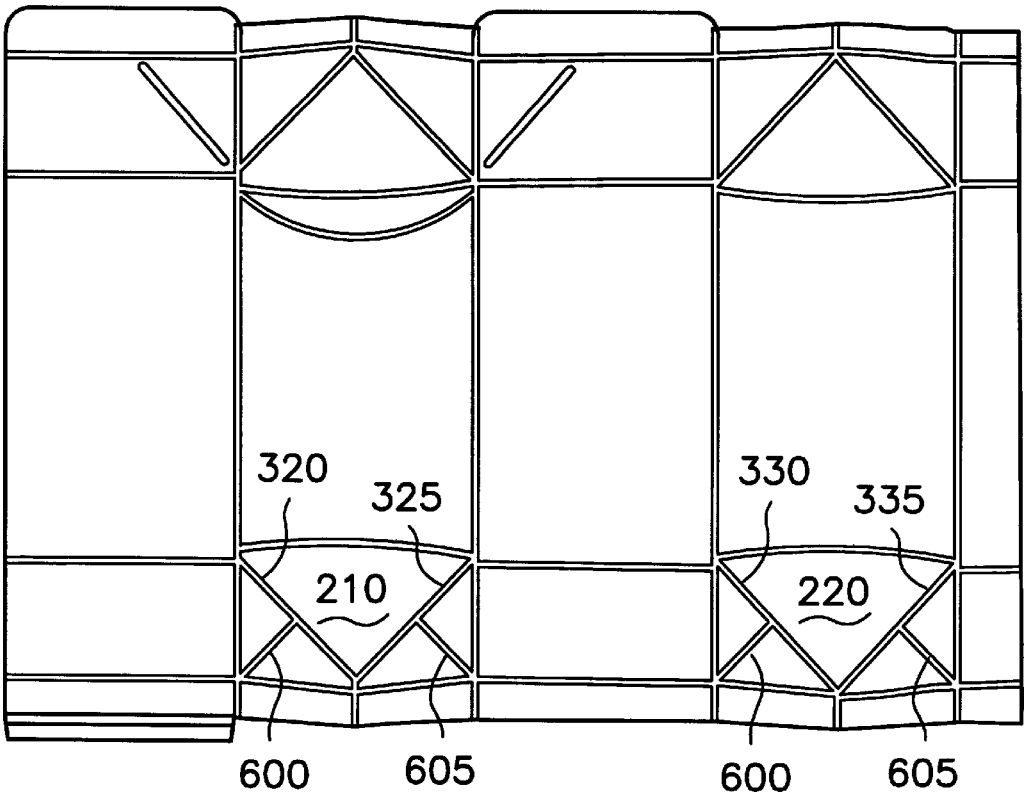
FIGS. 11–14 illustrate carton blanks having various score line configurations for the bottom structure of the carton.

FIGS. 11–14 illustrate carton blanks having added score lines which assist in providing a more structurally sound recessed bottom structure than bottom structures that do not have such added score lines. In the embodiment of FIG. 11, diagonal score lines 600 and 605 extend from the converging score lines 320, 325 to the lower corners of the second bottom flap 210. A similar score line configuration is supplied on the fourth bottom flap 220 as well.

Figure 12:
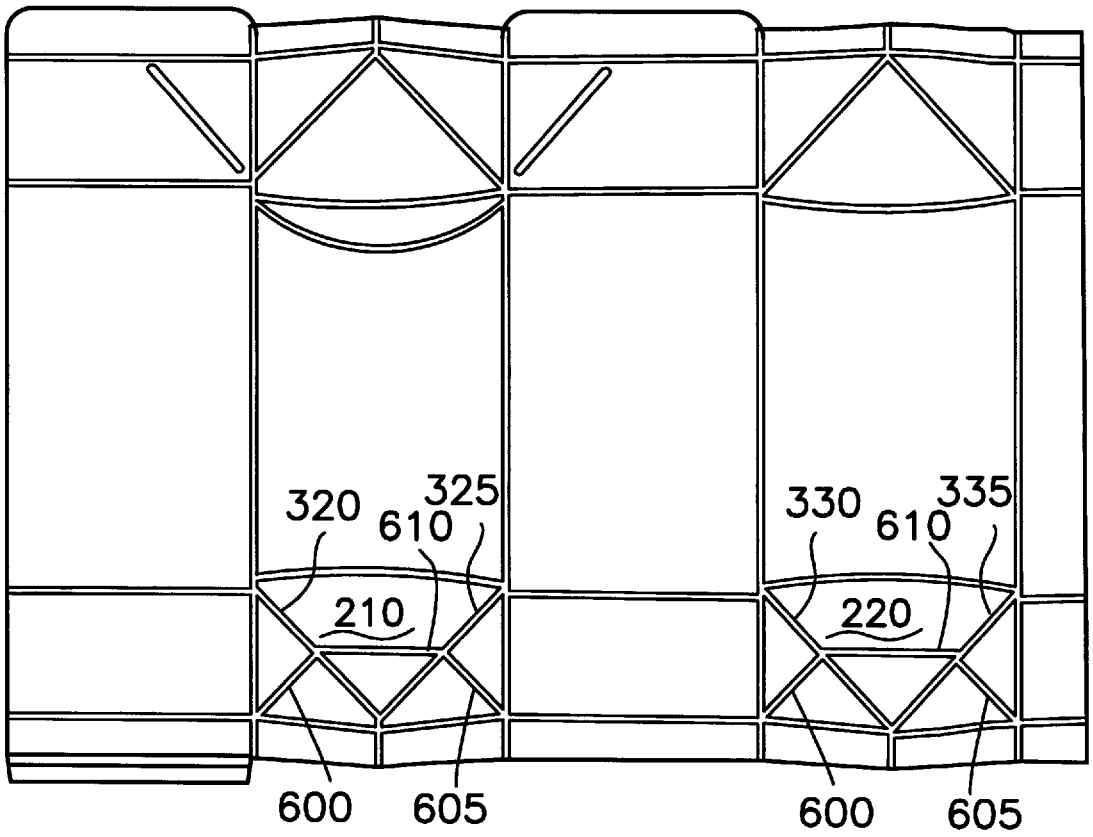

The embodiment of FIG. 12 is similar to the embodiment shown in FIG. 11 except that an added horizontal score line 610 is provided that interconnects the diagonal score lines 600 and 605. A similar score line configuration is supplied on the fourth bottom flap 220 as well.

Figure 13:
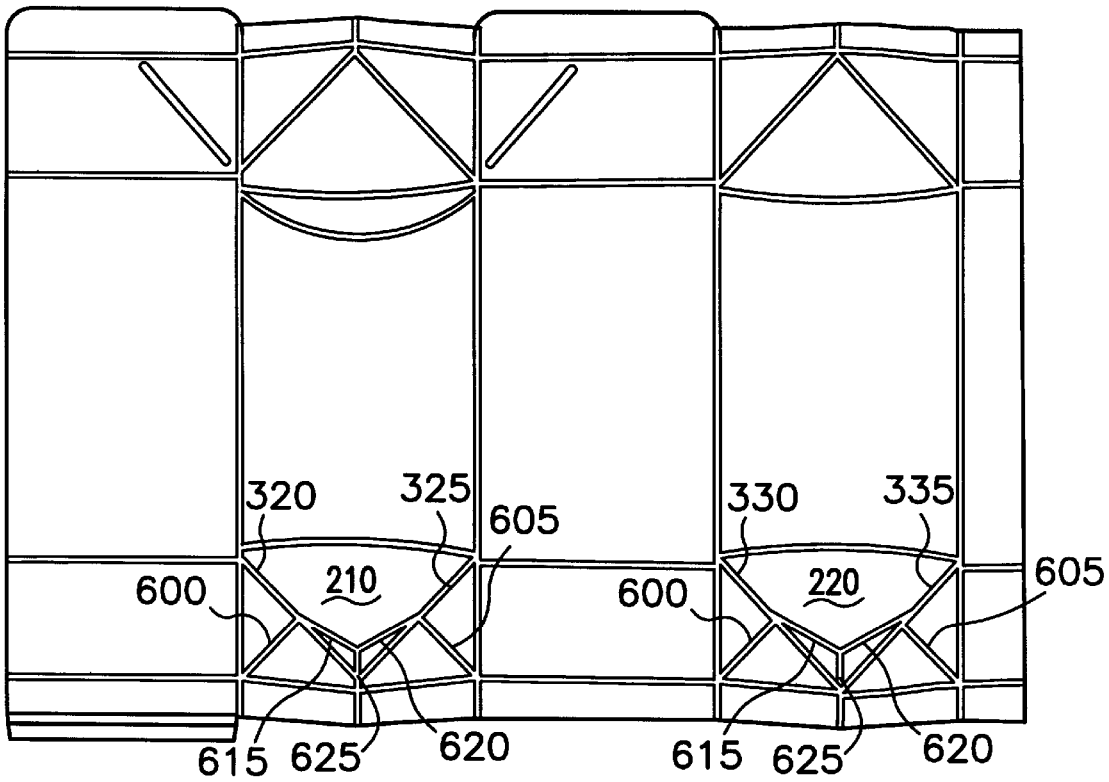

The embodiment of FIG. 13 is similar to the embodiment shown in FIG. 12 except that a generally Y-shaped score line configuration is used in lieu of the horizontal score line 610. The generally Y-shaped score line configuration includes a pair of diagonal arm portions 615 and 620 which intersect a vertical score line 625. The diagonal arm portions 615 and 620 intersect at the mid-portions of diagonal score lines 320, 325 and 330, 335. This score line configuration is provided on both the second and fourth bottom flaps 210 and 220.

Figure 14:
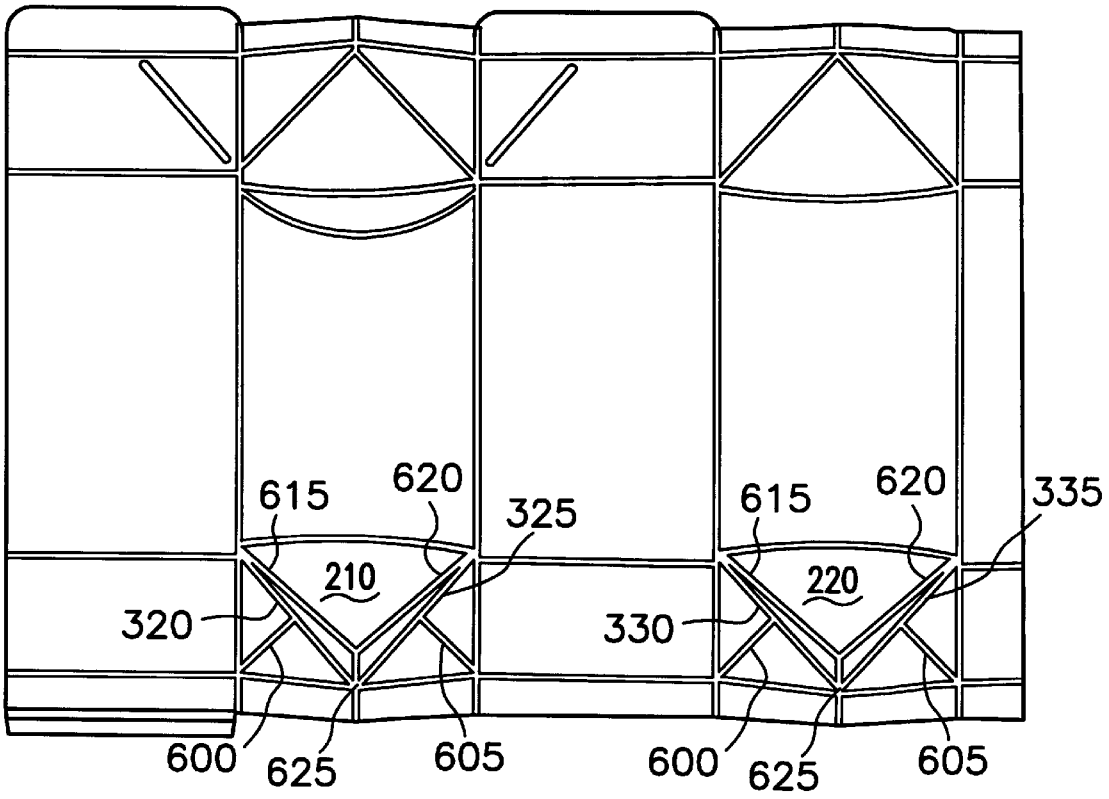

The embodiment of FIG. 14 is similar to the embodiment of FIG. 13 except that the diagonal arm portions 615 and 620 intersect the diagonal score lines 320, 325 and 330, 335 at the upper corners of the bottom flaps 210 and 220.

Figure 15:
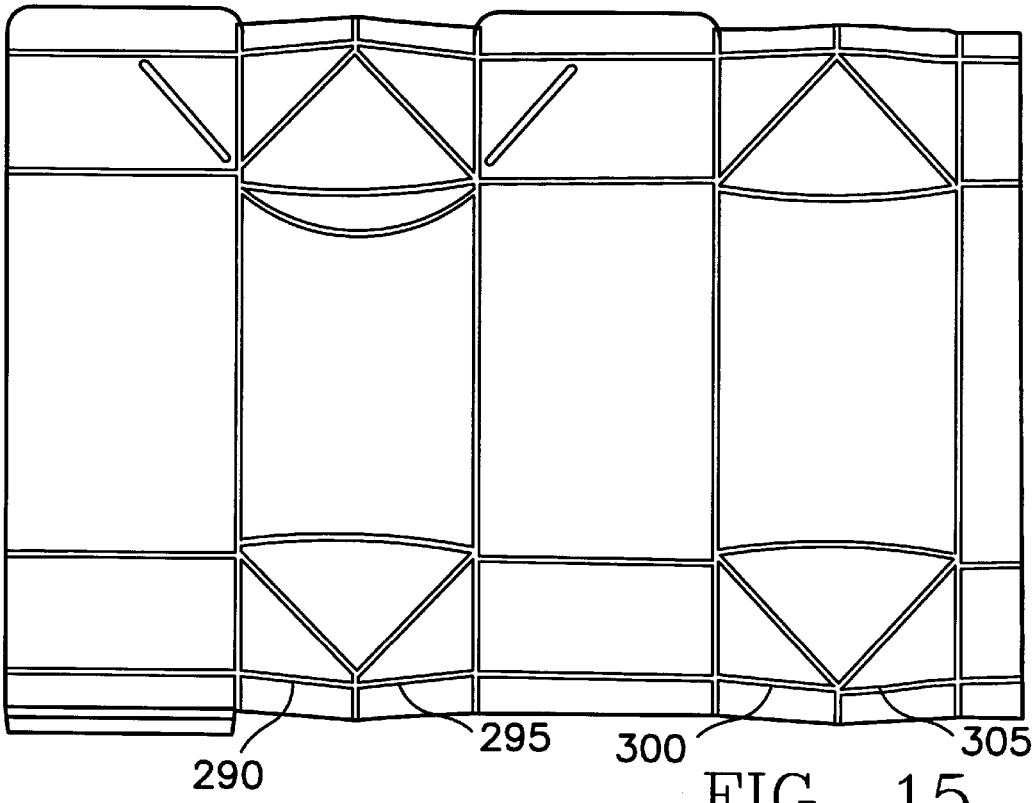
FIG. 15 illustrates a carton blank having an alternative orientation of the wide score lines that proceed across the bottom portions of the bottom flaps.
Figure 16:
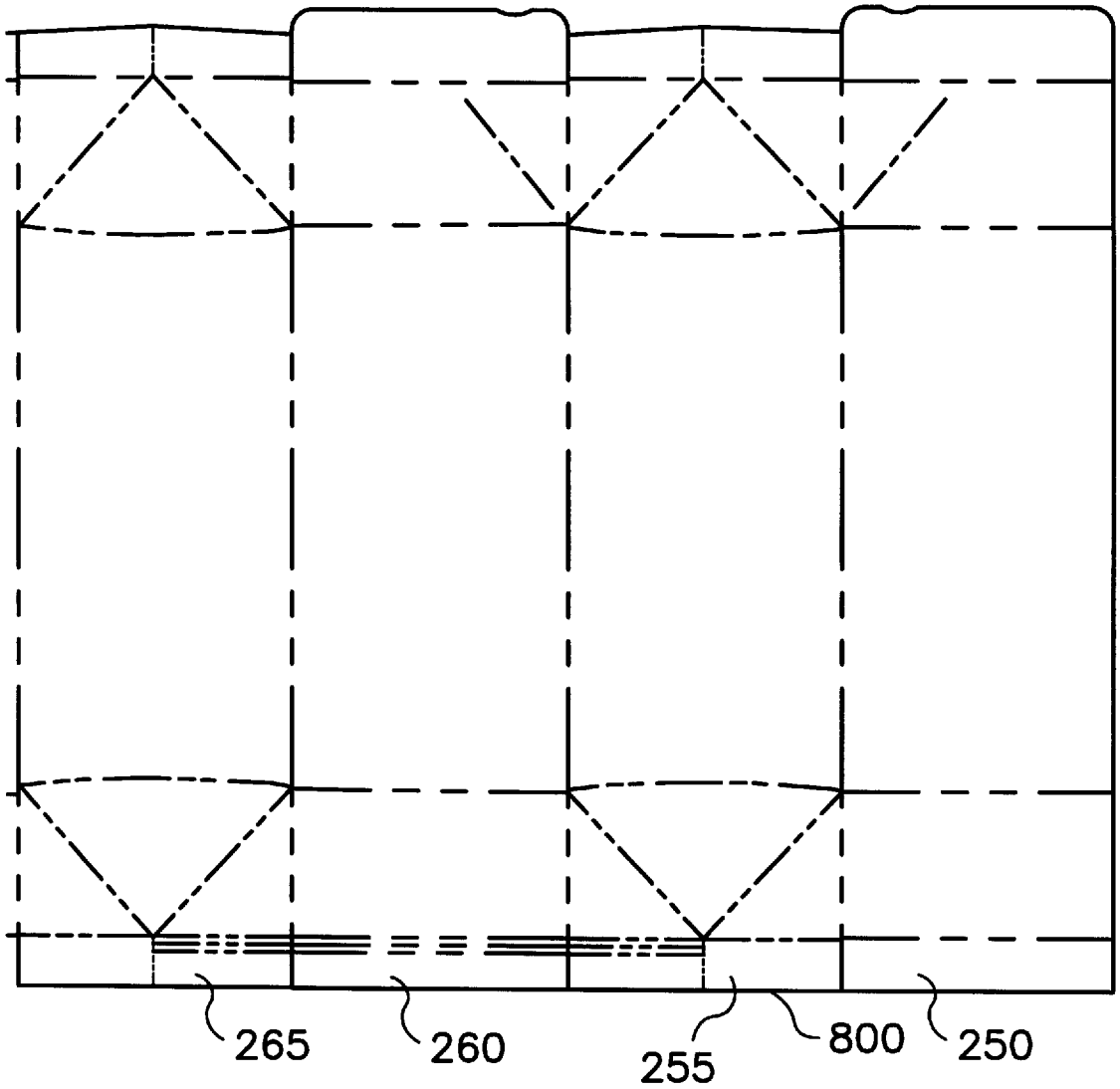
FIG. 16 illustrates a carton blank wherein the bottom of the blank is formed along a straight cut.

FIG. 15 illustrates an alternative orientation between the wide score lines 295, 300 and score lines 290, 305. In this alternative orientation, the upper and lower portions of the wide score lines 295, 300 are slightly below the upper and lower portions of the score lines 290, 305. FIG. 16 illustrates an alternative embodiment wherein the bottom of fin flaps 250, 255, 260, and 265 proceed at the bottom along a straight edge 800.

Figure 17:
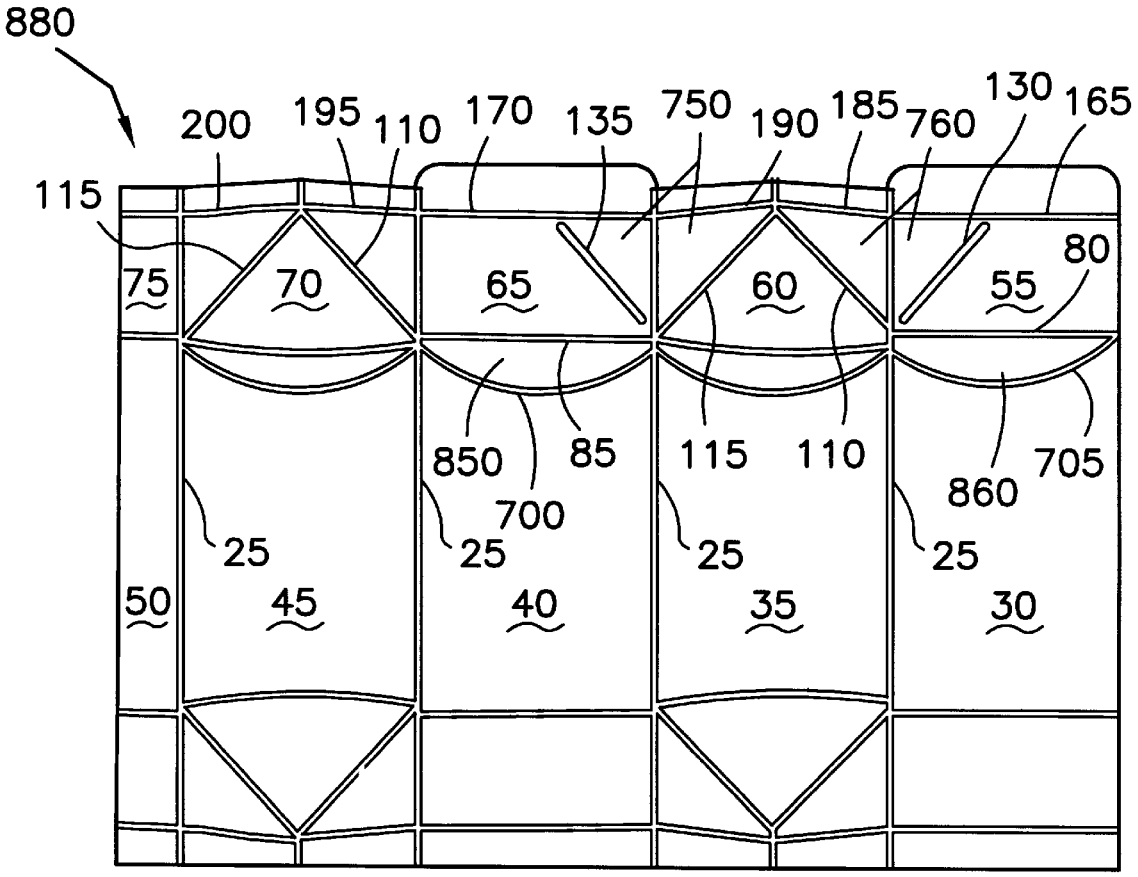
FIG. 17 is a plan view of a carton blank with indent surfaces to assist in the opening of the carton.
Figure 18:
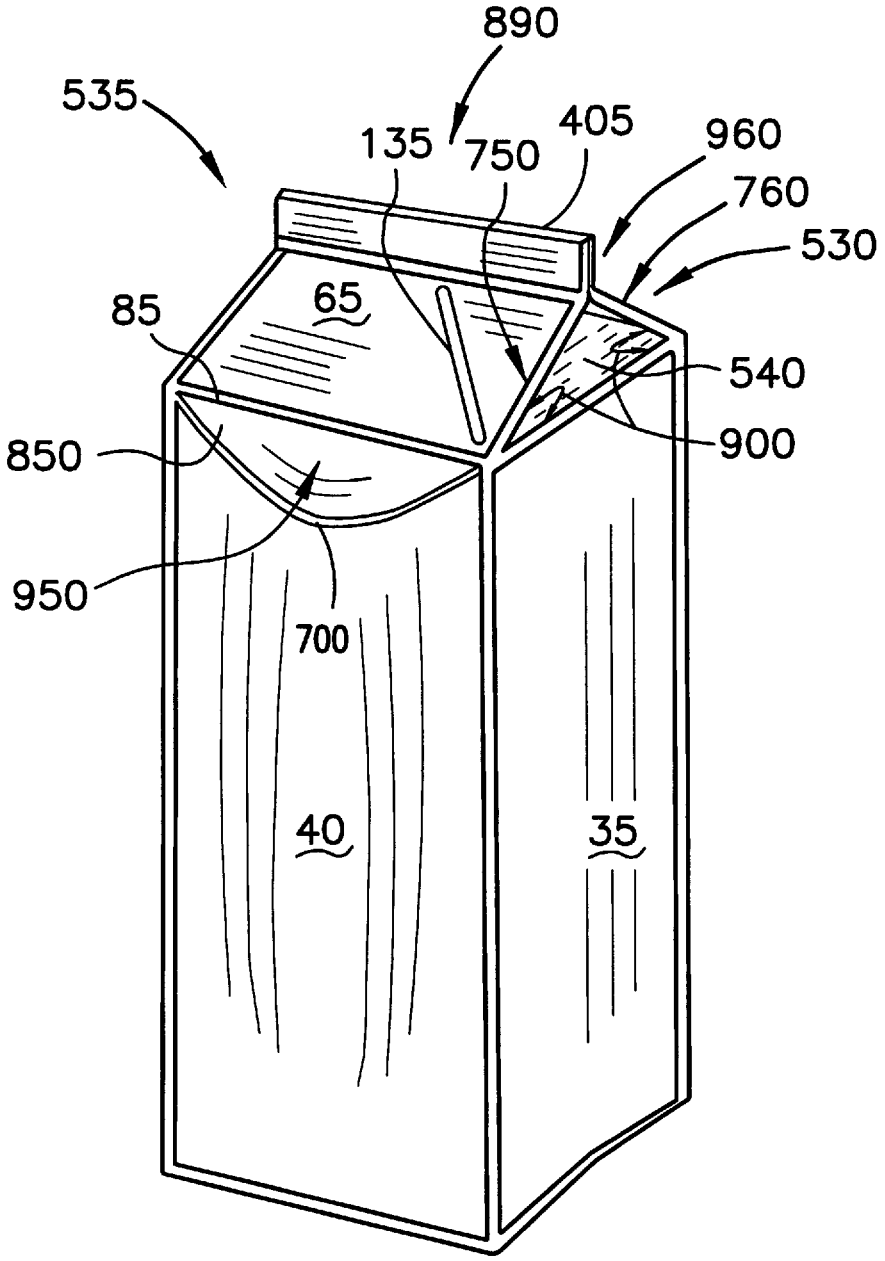
FIG. 18 is a perspective view of the folded and sealed carton of FIG. 17.
Figure 19A:
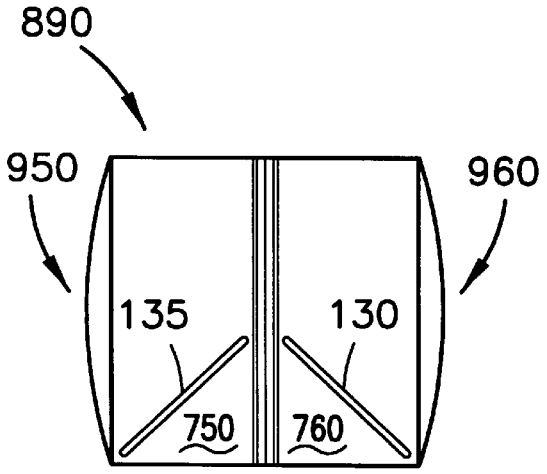
FIGS. 19A–D, 20A–D, 21A–D show a side-by-side comparison (top and elevational views) of cartons with and without indent surfaces at various stages in the opening process.
Figure 19C:
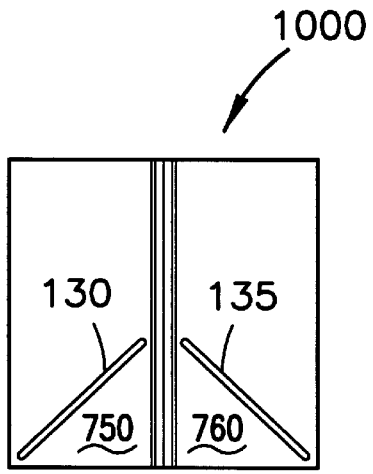
(PRIOR ART) FIG. 19C
Figure 19B:
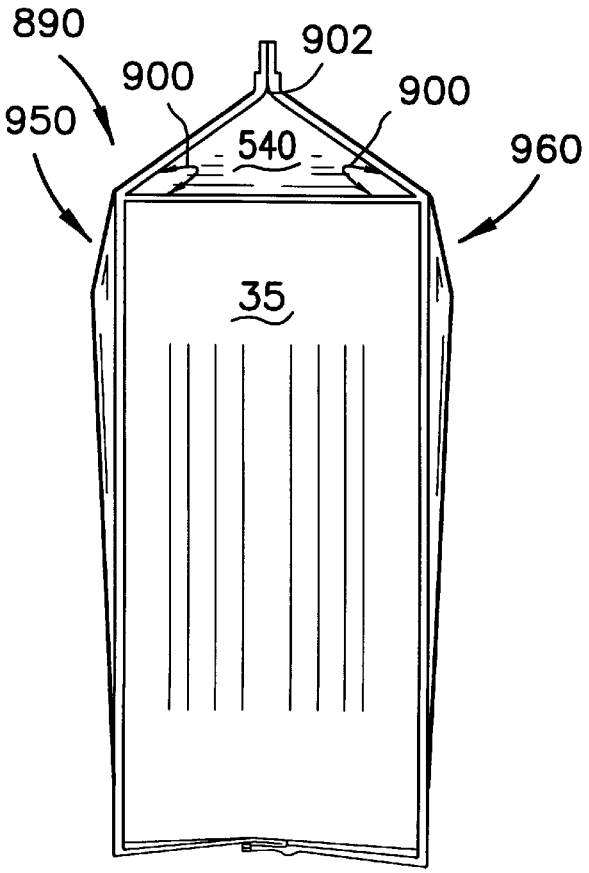
Figure 19D:
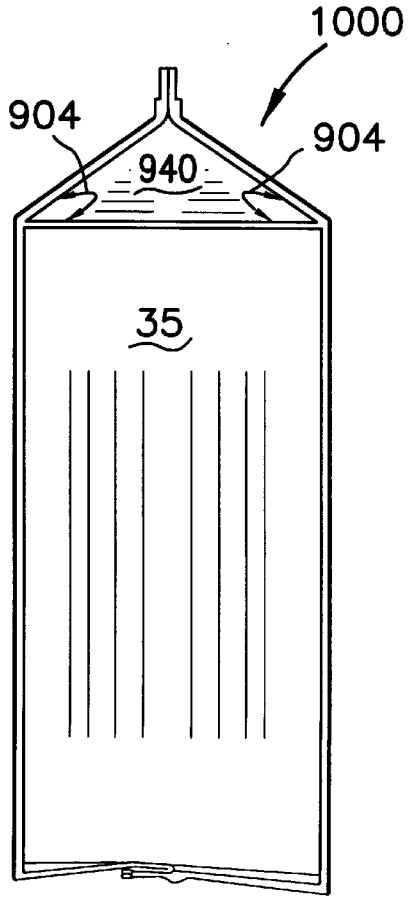
(PRIOR ART) FIG. 19D

FIG. 17 illustrates a further unique and beneficial use of curved score lines wherein there is shown a carton blank that may be used to form cartons having a reduced likelihood of "rolling" during opening thereof. More particularly, FIG. 17 illustrates one embodiment of a carton blank 880 having added curved score lines which assist in the opening of the carton by (a) reducing the risk of rolling, and (b) enlarging the opening area utilized by a user to open the carton. In the embodiment of FIG. 17, a curved score line 705 extends, preferably, across the entire width of the first side panel 30 adjacent the score line 80. As will be explained further below, the curved score line 705 and the score line 80 of the first side panel 30 define an indent surface 850 therebetween. Similarly, a curved score fine 700 extends, preferably, across the entire width of the third side panel 40 adjacent the score line 85. The curved score line 700 and the score line 85 of the third side panel 40 define an indent surface 850 therebetween. In each instance, the curved score line 700 and 705 preferably extends between the end points of the respective score line 85 and 80. Diagonal score lines 135 and 115, straight score lines 170 and 190, and one of the vertical score lines 25 generally define spout flap 750. Similarly, diagonal score lines 130 and 110, straight score lines 165 and 185, and one of the vertical score lines 25 generally define spout flap 760. The resulting folded gable-top carton 890 is shown in FIG. 18. The gable-top carton 890 includes an opening end 530, closed end 535, and the first and third top flaps 55 and 65 with their respective diagonal score lines 130 and 135, and underlying gabled portions comprising the top flap panels 60 and 70. The top flaps 55 and 65 form the oppositely angled roof portions of the gable top. The third top flap 65 engages the third side panel 40 at the score line 85. The curved score line 700 extends across the width of the third side panel 40 adjacent the score line 85 and, preferably, extends between and connects the end points of the score line 85 across the entire width of the side. As noted above, between the score line 85 and the curved score line 700 there is an indent surface 850. Although not shown, on the opposite side of the gable-top carton 890, the first top flap 55 engages the first side panel 30 at the score line 80. The curved score line 705 extends across the width of the third side panel 30 adjacent the score line 80. As noted above, between the score line 80 and the curved score line 705 there is an indent surface 860.

Often times, because the user cannot bend back the spout at the opening end 530 more than the roof angles 900 of the gable, rolling occurs. In other words, the spout does not bend at the performed diagonal creases 130 and 135. As a result, the carton often will not open properly.

To overcome this problem, the user may apply forces to the indent surfaces 850 and 860 in the direction shown by arrows 950 and 960. By virtue of the construction of the indent surfaces 850 and 860, application of these forces allows controlled deformation of the gabled top. More particularly, the roof angles 900 are increased since the controlled deformation urges the spout flaps 750 and 760 upward and away from one another. It therefore becomes more likely that the spout flaps 750 and 760 will bend backward on the performed diagonal creases 130 and 135, and in turn, the gable-top carton 890 will open properly. As an added benefit, by increasing roof angles 900, the open area 540 underlying the spout flaps 750 and 760 is increased, providing more room for the user to place his or her thumbs, or the like, to pry open the top in 405 to access the contents of the gable-top carton 890.

A comparison between the opening of carton 890 having the indent surfaces 850 and 860, and a container 1000 that experiences rolling is illustrated in FIGS. 19–21. FIGS. 19A, 19B, 20A, 20B, 21A, and 21B show the gable-top carton 890 of FIG. 17 with the indent surfaces 850 and 860 from a top view (the 'A" series figures.) and side elevational views (the "B" series figures) in the progressive stages of opening. Similarly, FIGS. 19C, 19D, 20C, 20D, 21C, and 21D show a gable-top carton 1000 without indent surfaces, top views (the 'C' series Figures) and side elevational views (the "D" series figures) in the progressive stages of opening. As the comparative figures show, the gable-top carton 1000 without indent surfaces experiences rolling.

Specifically, FIGS. 19A, 19B, 19C, and 19D show two cartons, the gable-top carton 890 with indent surfaces (FIGS. 19A and 19B) and the gable-top carton 1000 without indent surfaces (FIGS. 19C and 19D), at the initial stage of opening. In accordance with one aspect of the present invention, the user applies forces to the indent surfaces 850 and 860 of the gable-top carton 890 in the general directions shown by arrows 950 and 960 of FIGS. 19A and 19B. The applied forces result in a controlled deformation of the carton 890 that causes the roof angles 900 to increase thereby causing an enlargement of the open region 540. Additionally, the deformation may cause a slight separation at the gabled peak 902 at the base of the fin 405 thereby preparing the in for opening. In contrast, the carton 1000 without the indent surfaces 850 and 860 has roof angles 904 that are less than the roof angles 900 of its counterpart on carton 890. The effect of these reduced angles and the corresponding increased angles of carton 890 are more easily described in connection with FIGS. 20 and 21.

Figure 20A:
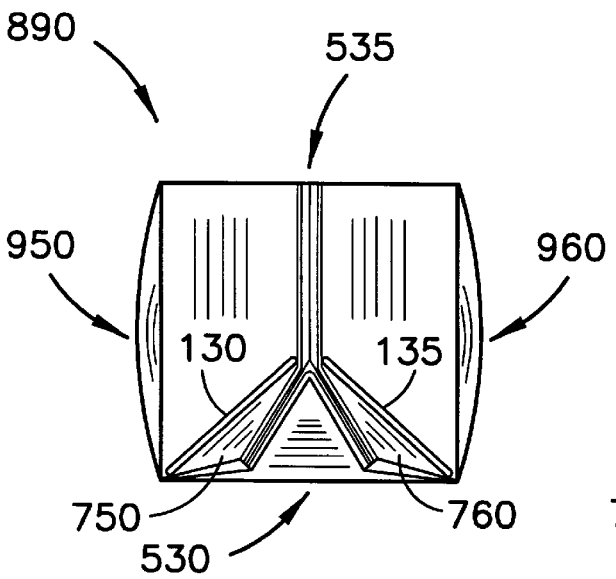
Figure 20C:
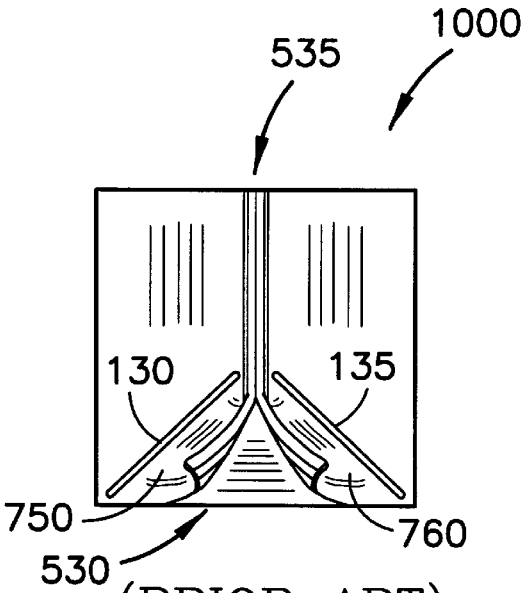
(PRIOR ART) FIG. 20C
Figure 20B:
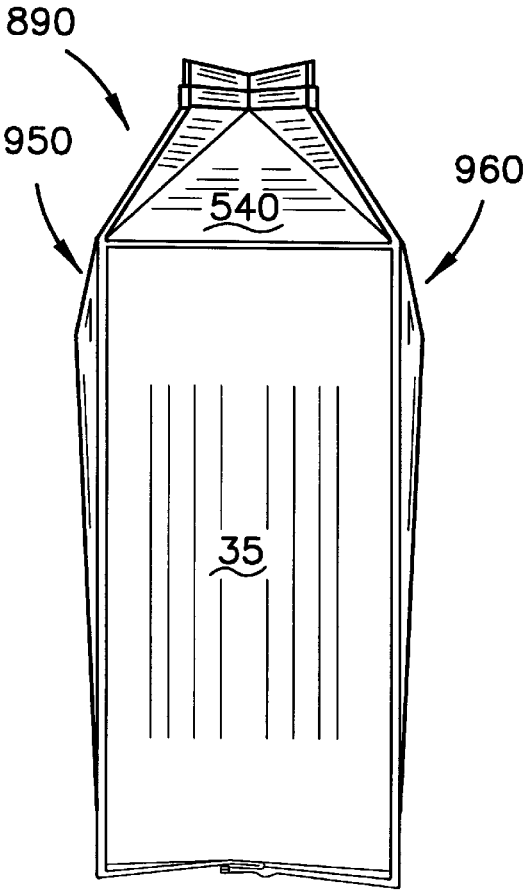
Figure 20D:
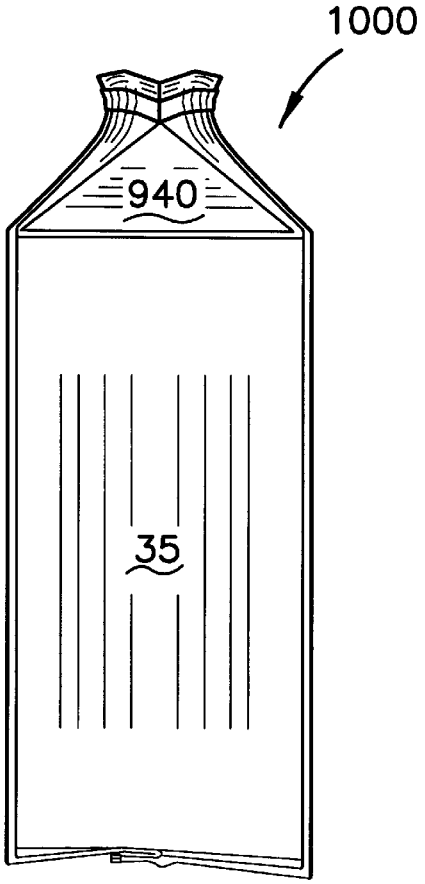
(PRIOR ART) FIG. 20D

FIGS. 20A, 20B, 20C, and 20D illustrate a subsequent stage in the opening 5 process where the spout flaps 750 and 760 are bent backward toward the closed end 535 of the carton. As shown in FIGS. 20A and 20B, the spout flaps 750 and 760 of the gable-top carton 890 with the side indent surfaces 650 and 860 bend on the performed diagonal creases 130 and 135. On the other hand, the carton 1000 experiences rolling wherein the spout flaps 750 and 760 of the gable-top carton 1000 without indent surfaces do not bend on the diagonal score lines 130 and 135, making the opening of the gable-top carton 1000 more difficult. Moreover, comparing FIG. 208 to FIG. 20D, the opening area 530 of the gable-top carton 890 with indent surfaces 850 and 860 is larger than the opening area 940 of the gable-top carton 1000 without indent surfaces, thus providing more room for the users fingers, or the like, to open the gable-top carton 890.

Figure 21A:
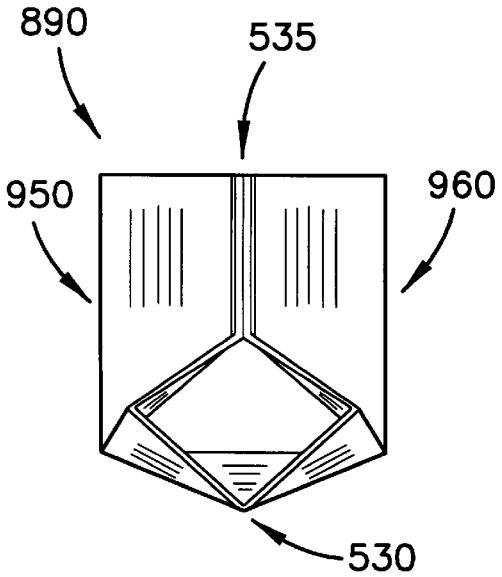
Figure 21C:
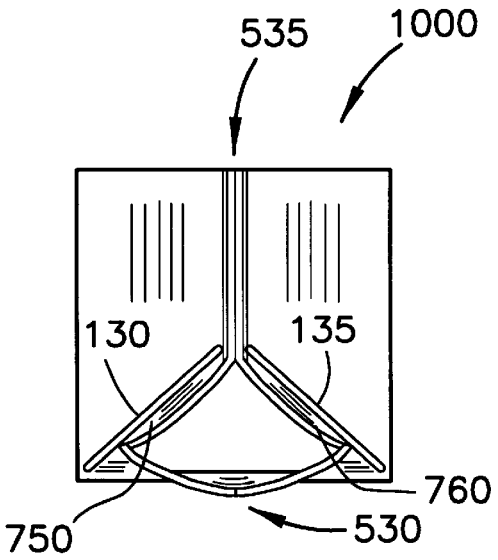
(PRIOR ART) FIG. 21C
Figure 21B:
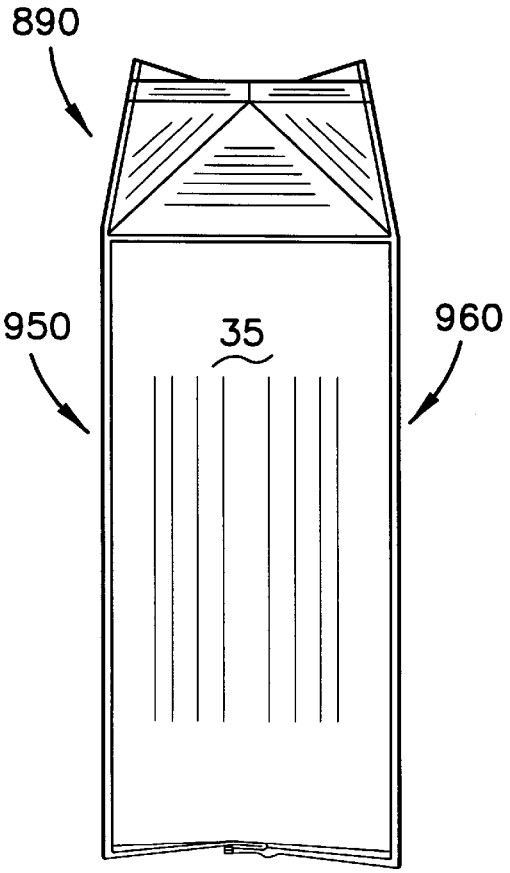
Figure 21D:
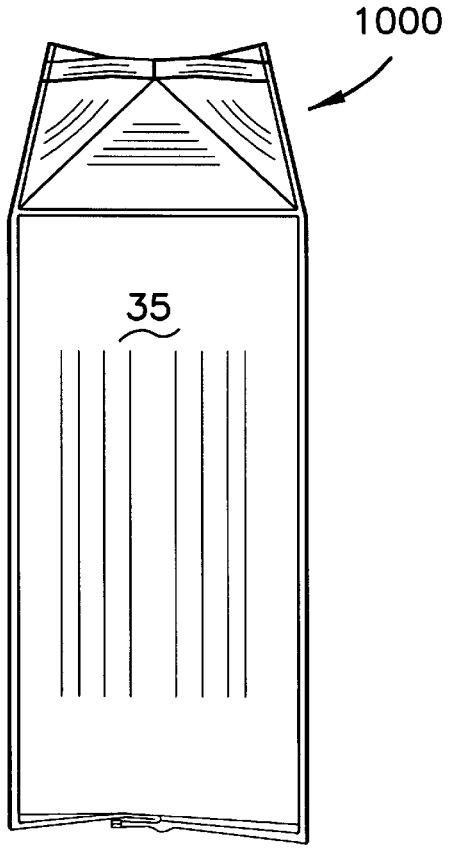
(PRIOR ART) FIG. 21D

FIGS. 21A, 21B, 21C, and 21D illustrate an even later stage in the opening process wherein the spout flaps 750 and 760 are pushed forward towards the opening end 530 to open the carton. As shown by FIG. 21C, when the spout flaps 750 and 760 do not bend on the diagonal creases, the gable-top carton 1000 does not open property, instead experiencing continued rolling. In contrast, the spout flaps of carton 890 do not experience such rolling, instead opening properly as illustrated.

Figure 22:
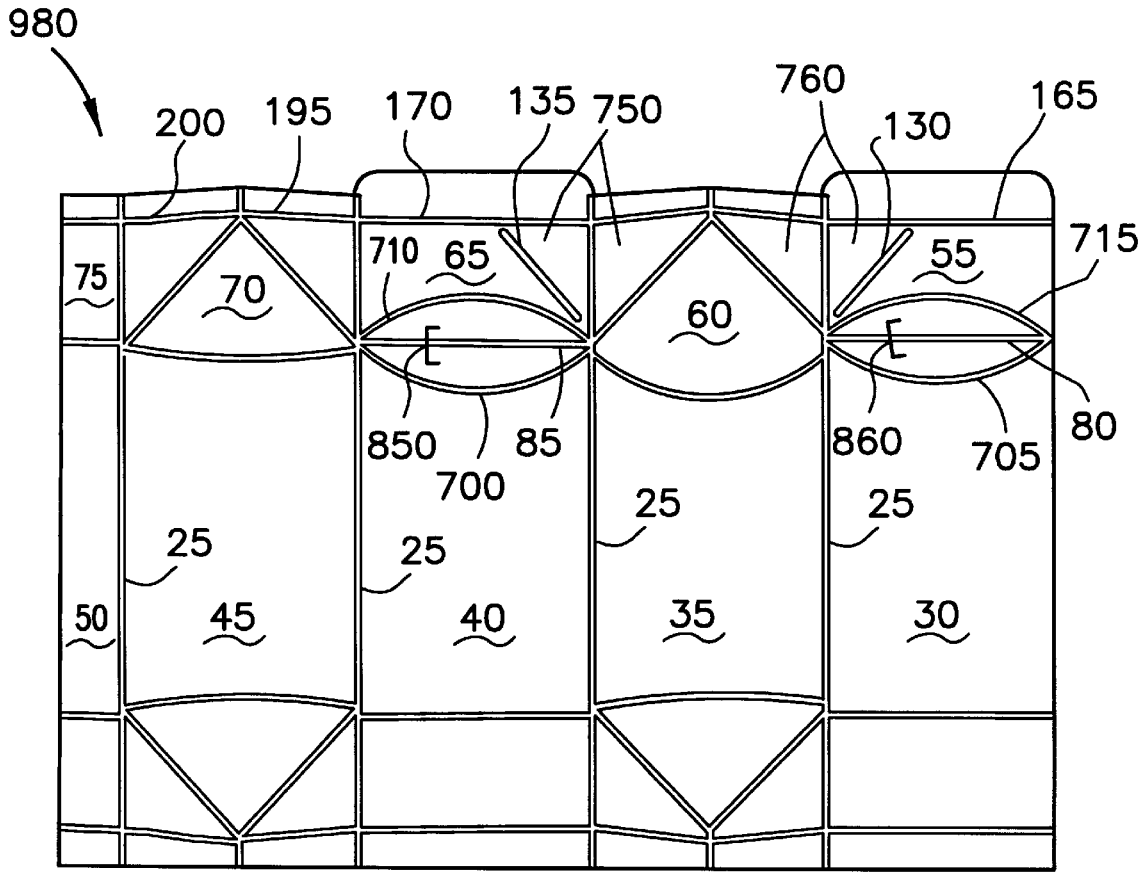
FIG. 22 is an alternate embodiment of a carton blank with indent surfaces to assist in the opening of the carton.

While the embodiment of FIG. 17 can reduce the risk of rolling, as shown in FIGS. 19–21, other score line configurations can reduce the risk as well. For example, a further embodiment is shown in FIG. 22. As illustrated, the carton blank 980 of FIG. 22 is similar to the carton blank 880 of FIG. 17 except there is an added curved score fine 710 that extends across the third top flap 65 adjacent the score line 85. The indent surface 850 of FIG. 17 is now defined at its perimeter by the curved score lines 700 and 710 of FIG. 22. Likewise, an added curved score line 715 extends across the first top flap 55 adjacent the score line 80. The indent surface 860 of FIG. 17 is now defined at its perimeter by the curved score lines 705 and 715 of FIG. 22.

One or more of the score lines 700, 705, 710, and 715 may be formed in a shape other than the illustrated curved shape. For example, one or more such score lines may each be in the form of one or more linear segments, curved segments, etc., that facilitate controlled deformation of the carton so as to increase the roof angles.

It will be readily recognized that the embodiments of FIGS. 17 and 22 can be used in combination with various score line structures shown in connection with the embodiments of FIGS. 1–16. Such added score lines include those defining the indent surface 105 on the second side panel 35 adjacent to the opening end 530, the use of further curved score lines 90, 240, 95 and 245 at the top and bottom of the side panels 35 and 45, as well as the score lines defining the various bottom configurations and top configurations illustrated herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A gable top carton comprising:

a gabled structure having an opening end, a fin, and first and second oppositely angled roof portions extending from and engaging the fin, the first and second oppositely angled roof portions forming spout flaps at the opening end, the spout flaps being adapted for folding back along a predefined score line configuration during opening of the carton;

a plurality of side panels engaging said gabled structure, including first and second opposite side panels respectively engaging the first and second oppositely angled roof portions;

a first score line defining a crease formed at the engagement between the first side panel and the first angled roof portion;

a second score line defining a crease formed at the engagement between the second side panel and the second angled roof portions;

a first complementary score line on the first side panel disposed adjacent the first score line and defining a first indent surface between the first score line and the first complementary score line; and second complementary score line on the second side panel disposed adjacent the second score line and defining a second indent surface between the second score line and the second complementary score line.

2. A gable top carton according to claim 1 wherein the first and second complementary score lines are curved score lines.

3. A gable top carton according to claim 2 wherein the first and second complementary score lines extend along the entire length of the respective side panel.

4. A gable top carton according to claim 2 wherein the predefined score line configuration comprises first and second diagonal score lines respectively disposed on said first and second oppositely angled roof portions.

5. A gable top carton according to claim 2 further comprising:

a third complementary score fine on the second side panel disposed adjacent the second score line, the first indent surface extending between the first and third complementary score lines; and a fourth complementary score line on the second angled roof portion disposed adjacent the second score line, the second indent surface extending between the second and fourth complementary score lines.

6. A gable top carton according to claim 5 wherein the third and fourth complementary score lines are curved score lines.

7. A gable top carton according to claim 6 wherein the predefined score line configuration comprises first and second diagonal score lines respectively disposed on the first and second oppositely angled roof portions.

8. A gable top carton according to claim 1 further comprising:

a third complementary score line on the second side panel disposed adjacent the second score line, the first indent surface extending between the first and third complementary score lines; and a fourth complementary score line on the second angled roof portion disposed adjacent the second score line, the second indent surface extending between the second and fourth complementary score line.

9. A blank for forming a gable top carton comprising:

first, second, third, and fourth side panels, the side panels divided from one another by a plurality of vertical score lines;

first, second, third, and fourth top flaps respectively adjacent the first, second, third, and fourth side panels, wherein the first and third top flaps respectively form first and second oppositely angled roof portions of the gable top when the blank is folded to form the carton;

first, second, third, and fourth score lines formed at the engagement between the first, second, third, and fourth side panels and the first, second, third, and fourth top flaps;

a first complementary score line on the first side panel disposed adjacent the first score line and defining a first indent surface between the first score line and the first complementary score line when the blank is folded to form the carton; and a second complementary score fine on the third side panel disposed adjacent the third score line and defining a second indent surface between the third score line and the second complementary score line when the blank is folded to form the carton.

10. A blank according to claim 9 wherein the first and third top flaps respectively contain first and second diagonal score lines to facilitate opening of the carton when the blank is folded to form a carton.

11. A blank according to claim 9 wherein the first and second complementary score lines are curved.

12. A blank according to claim 11 further comprising:

a third complementary score line on the first top flap disposed adjacent the first score line; and a fourth complementary score line on the third top flap disposed adjacent the third score line.

13. A blank according to claim 12 wherein the third and fourth complementary score lines are curved score lines.

14. A blank according to claim 13 wherein the first and third top flaps respectively contain first and second diagonal score lines to facilitate opening of the carton when the blank is folded to form a carton.

15. A blank as claimed in claim 13 wherein said first and third top flaps respectively contain first and second diagonal score lines to facilitate opening of the carton when the blank is folded to form a carton.

16. A blank according to claim 11 wherein the first and third top flaps respectively contain first and second diagonal score lines to facilitate opening to the carton when the blank is folded to form a carton.

17. A blank according to claim 9 further comprising:

a third complementary score line on the first top flap disposed adjacent the first score line; and a fourth complementary score line on the third top flap disposed adjacent the third score line.

18. A blank according to claim 17 wherein the third and fourth complementary score lines are curved score lines.

19. A blank according to claim 18 wherein the first and third top flaps respectively contain first and second diagonal score lines to facilitate opening of the carton when the blank is folded to form a carton.

20. A blank according to claim 17 wherein the first and third top flaps respectively contain first and second diagonal score lines to facilitate opening to the carton when the blank is folded to form a carton.

21. A blank for forming a gable top carton comprising:

first, second, third, and fourth side panels, said side panels divided from one another by a plurality of vertical score lines;

first, second, third, and fourth top flaps respectively adjacent the first, second, third, and fourth side panels, wherein the second and fourth top flaps respectively form first and second oppositely angled roof portions of the gable top when the blank is folded to form the carton;

first, second, third, and fourth score lines formed at the engagement between the first, second, third, and fourth side panels and the first, second, third, and fourth top flaps;

a first complementary score line on the second side panel disposed adjacent the second score line and defining a first indent surface between the second score line and the second complementary score line when the blank is folded to form the carton; and a second complementary score line on the fourth side panel disposed adjacent the fourth score line and defining a second indent surface between the fourth score line and the second complementary score line when the blank is folded to form the carton.

22. A blank according to claim 21 wherein the second and fourth top flaps respectively contain first and second diagonal score lines to facilitate opening of the carton when the blank is folded to form a carton.

23. A blank according to claim 21 wherein said first and second complementary score lines are curved.

24. A blank according to claim 23 further comprising:

a third complementary score line on the first top flap disposed adjacent the first score line; and a fourth complementary score line on the third top flap disposed adjacent the third score line.

25. A blank according to claim 24 wherein the third and fourth complementary score lines are curved score lines.

26. A blank according to claim 25 wherein the first and third top flaps respectively contain first and second diagonal score lines to facilitate opening of the carton when the blank is folded to form a carton.

27. A blank according to claim 24 wherein the first and third top flaps respectively contain first and second diagonal score lines to facilitate opening of the carton when the blank is folded to form a carton.

28. A blank according to claim 23 wherein the first and third top flaps respectively contain first and second diagonal score lines to facilitate opening of the carton when the blank is folded to form a carton.

29. A blank according to claim 21 further comprising:

a third complementary score line on the second top flap disposed adjacent the second score line; and a fourth complementary score fine on the fourth top flap disposed adjacent the fourth score line.

30. A blank according to claim 29 wherein the third and fourth complementary score lines are curved score lines.

31. A blank according to claim 30 wherein the first and third top flaps respectively contain first and second diagonal score liens to facilitate opening of the carton when the blank is folded to form a carton.

32. A blank according to claim 29 wherein the first and third top flaps respectively contain first and second diagonal score lines to facilitate opening of the carton when the blank is folded to form a carton.

* * * * *